US006172663B1

(12) United States Patent
Okada et al.

(10) Patent No.: US 6,172,663 B1
(45) **Date of Patent: *Jan. 9, 2001**

(54) DRIVER CIRCUIT

(75) Inventors: Hisao Okada, Ikoma-gun; Yuji Yamamoto, Kobe; Sunao Etou, Tenri, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/613,320

(22) Filed: Mar. 11, 1996

(30) Foreign Application Priority Data

Mar. 14, 1995 (JP) ..... 7-054732

(51) Int. Cl.[7] ..... G09G 3/36
(52) U.S. Cl. ..... 345/96; 345/211; 345/99
(58) Field of Search ..... 364/707; 345/87, 345/89, 92, 94, 98, 100, 99, 211, 212, 213, 209, 96

(56) References Cited

U.S. PATENT DOCUMENTS

| | | | | |
|---|---|---|---|---|
| 4,196,432 | * | 4/1980 | Chihara | 345/209 |
| 4,707,692 | | 11/1987 | Higgins et al. . | |
| 5,260,606 | | 11/1993 | Young . | |
| 5,495,287 | * | 2/1996 | Kasai et al. | 345/89 |
| 5,528,256 | * | 6/1996 | Erhart et al. | 345/96 |

FOREIGN PATENT DOCUMENTS

| | | |
|---|---|---|
| 0 377 955 | 7/1990 | (EP) . |
| 0 611 144 | 8/1994 | (EP) . |
| 60-59389 | 4/1985 | (JP) . |
| 3-219288 | 9/1991 | (JP) . |
| 4-145490 | 5/1992 | (JP) . |
| 5-53534 | 3/1993 | (JP) . |
| 5-216443 | 8/1993 | (JP) . |

OTHER PUBLICATIONS

Okada et al, "An 8.4–in.color TFT–LCD and the Driving Technologies", Technical Report of IEICE, vol. 92, No. 469, ED92–151, pp. 27–33, 1993.

* cited by examiner

*Primary Examiner*—Kent Chang
(74) *Attorney, Agent, or Firm*—Nixon & Vanderhye P.C.

(57) ABSTRACT

A driver circuit for driving a capacitive load has a first electrode and a second electrode. The driver circuit includes: a first charging section, connected with the first electrode, for applying a charge to the first electrode during a. first period and receiving a charge from the first electrode during a second period; a second charging section, connected with the second electrode, for receiving a charge from the second electrode during the first period and applying a charge to the second electrode during the second period; a first section for prohibiting a movement of a charge between the first charging section and the first electrode during a third period between the first period and the second period; a second section for prohibiting a movement of a charge between the second charging section and the second electrode during the third period; and a third section for allowing a movement of a charge between the first electrode and the second electrode during a fourth period included in the third period.

11 Claims, 19 Drawing Sheets

FIG. 5
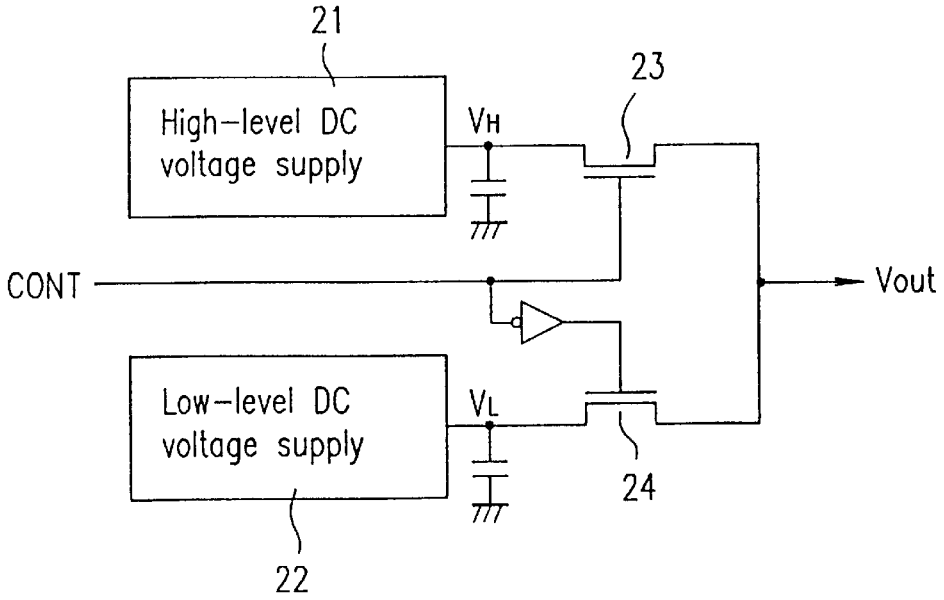
FIG. 6A
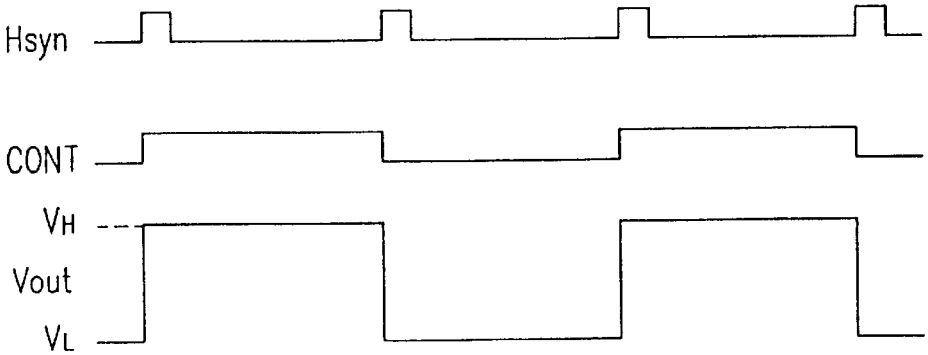
FIG. 6B
FIG. 6C

A row boundary between a positive potential region and a negative potential region moves downwards row by row every time one horizontal period has passed $$Qp = Cp|V0 - Vcom|$$

DRIVER CIRCUIT

BACKGROUND OF THE INVENTION

1. Field of the Invention:

The present invention relates to a driver circuit used for driving an active-matrix type liquid crystal display device in which liquid crystal is interposed between a pair of substrates.

2. Description of the Related Art:

In driving a liquid crystal display device, the response speed of the liquid crystal functioning as a display medium is considerably lower than that of a luminescent material used for a cathode-ray tube (CRT). A driver circuit of a particular type is currently used for driving the liquid crystal display device.

The driver circuit for a liquid crystal display device receives image signals sequentially, but does not apply the received image signals to respective pixels sequentially. That is, the driver circuit for a liquid crystal display device holds the image signals which have been sampled so as to correspond to the respective pixels, during one horizontal period. Then, the driver circuit for a liquid crystal display device outputs all the image signals at a time at the beginning or in the middle of the next horizontal period. The driver circuit for a liquid crystal display device continues to output the voltage of the image signals for a time period long enough to charge the respective pixel electrodes with the voltage. The time period during which the voltage continues to be output is called "one output period". In general, the length of the output period is approximately equal to the length of one horizontal period, in many cases.

A large-scale integrated circuit (LSI) called a "driver" is used for performing the driving method described above. There are two kinds of drivers, i.e., a data driver (also called a column driver or a source driver) for performing the sampling and the image signal output described above, and a scanning driver (also called a row driver or gate driver) for scanning a liquid crystal display device by every horizontal line. In the following description, a data driver will be referred to as a "driver" except in a few special instances.

FIG. 9 is a diagram showing a simplified configuration for a liquid crystal display device 100 and for a driver circuit including data drivers 101 and scanning drivers 102. S(i) indicates an output from the i-th data driver 101; G(j) indicates an output from the j-th scanning driver 102; and P(j, i) indicates a pixel formed at the crossing between the i-th column and the j-th row. The arrows under pixels P(l, i), P(l, i+1), P(j, i), P(j, N), etc. indicate that these pixels are connected with a common electrode.

FIG. 10 is a circuit diagram showing a configuration for the data driver 101 corresponding to one output on the i-th column through which a digitized image signal is supplied. The circuit which has the same configuration as that shown in FIG. 10 is provided to each of the data electrodes (also called data lines) $O_1$ to $O_N$ of the liquid crystal display device 100. FIG. 10 shows a case where image signal data is composed of three bits.

When a sampling pulse Tsmp(i) is supplied to an image signal which has been input to the i-th data driver 101, the signal is stored in an i-th sampling memory Msmp(i). After the sampling is finished for all the circuits in the above way, an output pulse LS is supplied at an appropriate timing, whereby all the data stored in the respective sampling memories Msmp are supplied to holding memories MH at a time. In this case, the data stored in the i-th sampling memory Msmp(i) is supplied to the i-th holding memory MH(i).

The data stored in each holding memory MH is input to a decoder DEC; one of eight analog switches $ASW_0$ to $ASW_7$ which corresponds to the value of the data is turned ON; and one of eight gray-scale voltages $V_0$ to $V_7$ is output through the analog switch which has been turned ON, thereby driving a corresponding data electrode of the liquid crystal display device 100. For example, if the value of the data is decimally 2, the level of the output S2 from the decoder DEC becomes high and the analog switch $ASW_2$ is turned ON, so that the gray-scale voltage $V_2$ is output from the circuit.

When one of the eight gray-scale voltages $V_0$ to $V_7$ is output from the circuit, the level of the output from the scanning driver 102 corresponding to a scanning electrode (also called a scanning line, a gate line or a row line) of a row to be used for display is high, and all the switching elements on the row turns ON. Then, each of pixel electrodes on the row is charged with the same voltage as the voltage of each corresponding data electrode. In other words, each pixel electrode is charged with the voltage output from the corresponding data driver 101, via the switching element turned ON.

For example, when the level of the j-th output from the scanning driver 102 becomes high in FIG. 9, all the switching elements T(j, 1) to T(j, N) connected with the scanning electrode Lj are turned ON. Accordingly, the pixels P(j, 1) to P(j, N) connected with the scanning electrode Lj are charged with the corresponding outputs S(l) to S(N) from the data drivers 101, respectively.

In driving the liquid crystal display device 100, it is necessary to invert the polarity of the voltage applied to the liquid crystal at regular intervals for preventing the liquid crystal from being degraded. Such a drive method is called an alternating current (AC) drive method for a liquid crystal display device. This drive method includes inverting the polarity of the output voltage from the driver 101 into positive or negative with respect to a counter electrode. A vertical inversion drive method (or a frame inversion drive method) in which the data voltage polarity is inverted frame by frame is the easiest method for performing the AC drive.

Hereinafter, the frame inversion drive method will be described in detail. FIGS. 11 and 12 show the waveforms of the respective voltages in the frame inversion drive method in which the gray-scale voltage $V_0$ is written into all the pixels. Hereinafter, it will be assumed that the voltage $V_0$ is written into all the pixels, except in some special cases.

In FIGS. 11 and 12, S(i) indicates an output from the i-th data driver 101; G(j) indicates an output from the j-th scanning driver 102, as the same manner in FIG. 9. In FIGS. 11 and 12, Hsyn indicates a horizontal synchronizing signal; LS indicates an output pulse as described referring to FIG. 10; and GCK indicates a clock signal for operating the scanning driver. The output pulses LS are sequentially output in synchronization with the leading edges of the respective clock signals GCK. In the following description, P(j, i), etc. indicates the potential level of a pixel.

As shown in FIG. 11, when the output pulse LSj is supplied, a voltage corresponding to the image data which has been supplied during the horizontal period Hj is output. During the horizontal period Hj+1, the level of the output G(j) from the j-th scanning driver is high, and the pixel P(j, i) is charged via the switching element T(j, i) so as to reach the level of the output voltage +VO of the output S(i) of the i-th data driver, as indicated by the arrow A in FIG. 11. That is, the potential of the P(j, i) is varied from the potential level −V0 in the previous frame to the potential level +V0 during the period Hj+1.

When the level of the output G(j) from the j-th scanning driver 102 becomes low, the switching element T(j, i) is turned OFF. As a result, the charges are held in the pixel P(j, i) and the potential level +V0 is maintained until the beginning of the write period in the next frame, i.e., the beginning of the horizontal period Hj+1 in FIG. 12. As indicated by the arrow A' in FIG. 12, the potential level of the pixel P(j, i) is inversely varied from +V0 to −V0 during the horizontal period Hj+1.

In case of the frame inversion drive method, the level of the output voltage S(i) from the i-th data driver 101 is positive +V0 all through the periods Hj−1 to Hj+1 in the frame shown in FIG. 11. To the contrary, a negative voltage −V0 is output throughout the periods Hj−1 to Hj+1 in the next frame shown in FIG. 12. Obviously, in the case where different data are written (or displayed) on the respective rows, a positive or negative voltage having a level corresponding to the data is output. In this case, although the levels of the output voltages may change, the polarity of the output voltages does not change during one frame period or one vertical period. That is, the data driver continues to charge or discharges a data electrode (or a data line) with a positive voltage or a negative voltage except for the first output (or writing onto the first row) of one vertical period.

As compared with the case of performing a row inversion drive to be described later in which the data electrode is charged or discharged with a positive voltage or a negative voltage so that the polarity of the voltages is inverted row by row, the power consumption to perform a frame inversion drive can be considerably reduced. An advantage of performing the frame inversion drive lies in such a small power consumption.

Next, the distribution of a positive or negative polarity of pixels of the entire display device driven in the frame inversion drive method will be analyzed. Before the horizontal period Hj+1 begins, the potential of all the pixels up to the (j−1)th row has already been rewritten into a positive potential. On the other hand, in the horizontal period Hj+1, the potential level of all the pixels after the (j+1)th row is equal to the level of the potential written in the previous frame, i.e., a negative potential. The potential level of the pixel P(j, i) on the j-th row is being rewritten. Therefore, during one vertical period, there are two separate regions of pixels, i.e., a region having a positive potential and a region having a negative potential, in the screen as shown in FIGS. 13A and 13B. The boundary between the two regions moves downwards row by row in the screen every time one horizontal period has passed. If an equilibrium does not exist between the transmittance with respect to the positive polarity of pixels and the transmittance with respect to the negative polarity of pixels, a visual defect is caused.

The reasons why the equilibrium would not exist between the transmittance with respect to the positive polarity of pixels and the transmittance with respect to the negative polarity of pixels are described as follows.

FIG. 14 shows waveform charts showing the relationship among the potential level of the pixel P(l, i) on the uppermost row, the potential level of the pixel P(M, i) on the lowermost row, and the respective outputs from the driver with reference to a vertical synchronizing signal Vsyn in the frame inversion drive.

Hereinafter, the period during which the output S(i) from the i-th data driver is positive (hereinafter, such a period will be referred to as a "positive drive period") will be described. Since the similar description is applicable to a negative drive period during which the output S(i) from the i-th data driver is negative, the description on the negative drive period will be omitted herein.

First, the potential variation of the pixel P(l, i) will be described. After the pixel P(l, i) has been charged to reach a positive potential level, the driver continues to output a positive potential during a period tp(1). In other words, the potential level of the corresponding data lines is positive throughout the period. On the other hand, the potential of the pixel P(M, i) is varied in a different manner. When the pixel P(M, i) has been charged, the driver completes the positive drive period. After a period tp(M) having approximately the same length as that of a retrace interval has passed, a negative drive period begins during which the driver outputs negative potentials.

Generally, a switching element is formed of a thin-film transistor (TFT), and has a limited OFF resistance $R_{off}$. Even in the period during which a switching element is on the OFF state, a very small amount of current leakage always exists between a pixel and a data line via the OFF switching element. When the potential of the data line has the same polarity as that of the pixel, the amount of such a current leakage is negligible because the potential difference between the pixel and the data line is small.

In addition, the current leakage can flow bidirectionally. For example, if the potential of the pixel is higher than that of the data line, the current flows from the pixel to the data line. On the other hand, if the potential of the pixel is lower than that of the data line, the current flows from the data line to the pixel.

However, if the potential of the data line has the opposite polarity to that of the pixel, a current leakage will flow in such a direction as causing a loss of the charges. The amount of the current leakage in case of which the potential of the data line has the opposite polarity to that of the pixel is larger than that in case of which the potential of the data line has the same polarity as that of the pixel.

It is positive charges that are lost when the polarity of the pixel is positive with respect to the common electrode. To the contrary, it is negative charges that are lost when the polarity of the pixel is negative with respect to the common electrode. In this example, the pixel P(M, i) loses a far larger amount of charges than the pixel P(l, i) does.

It is noted that the part of the broken lines of the output S(i) in FIG. 14 is not necessary. As shown in FIG. 14, it is preferable to continue to output a positive voltage during the positive drive period, and it is preferable to continue to output a negative voltage during the negative drive period.

FIG. 15 schematically shows an exemplary relationship between the potential variation of the pixel P(l, i) and that of the pixel P(M, i) with reference to the vertical synchronizing signal Vsyn. In FIG. 15, the potential levels of the pixel P(l, i) and the pixel P(M, i) and the waveform of the vertical synchronizing signal are extracted from FIG. 14.

In case of the frame inversion drive, there is a high possibility that pixels lose charges, and are different from each other depending upon the vertical positions of the pixels in the liquid crystal display device. In order to avoid a defective display resulting from such a phenomenon, it is necessary to drive the liquid crystal display device within a suitable range in a voltage-transmittance characteristic curve in which the loss of charges does not cause a change in the gray-scale tones.

The transmittance characteristics for a positive driving voltage with respect to a driving terminal of a liquid crystal display device are different from the transmittance characteristics for a negative driving voltage with respect to the driving terminal of the liquid crystal display device for various reasons. In general, such a difference is corrected by making a positive driving voltage with respect to a common electrode different from a negative driving voltage with respect to the common electrode.

For example, in case of the driver shown in FIG. 10, the aforementioned difference of transmittance characteristics is corrected by using a method proposed in Japanese Laid-Open Patent Publication No. 5-53534. In this method, the gray-scale voltages $V_0$ to $V_7$ with respect to the common electrode during the positive drive period are made slightly different from that during the negative drive period.

However, it is difficult to completely correct the aforementioned difference of transmittance characteristics for the following reasons: the voltage-transmittance characteristics are likely to be variable among respective liquid crystal display devices; the characteristics are varied even in one and the same liquid crystal display device depending upon the position of each pixel; and the potential variations caused by the above-described reasons during the OFF period of a switching element are different from each other depending upon the display pattern (that is, the potential variation is caused during the OFF period because of the potential difference between the pixel and the data line which are connected to the source or drain of the TFT, respectively). Therefore, some difference actually exists between the transmittance characteristics during the positive drive period and the transmittance characteristics during the negative drive period.

In case of the frame inversion drive, since one row and the row adjacent to the row have the same polarity, the transmittance characteristics for a positive drive period and a negative drive period are not equalized between adjacent rows. Such an equalization is performed only between adjacent frames. The period of the equalization becomes twice as long as the period of one frame.

In addition, since the boundary between the positive potential region and the negative potential region goes on moving as described above, not only unevenness but also various defects such as a flickering are likely to be caused in the displayed image.

Because of the above-described reasons, a row inversion drive method to be described below is generally employed for an active-matrix type liquid crystal display device performing a gray-scale tone display.

FIGS. 16 and 17 show the voltage waveforms of the respective outputs in the row inversion drive method.

The row inversion drive method includes the inverting the polarity of the data voltage row by row. That is, the driver alternately outputs a different voltage, i.e., a positive voltage and a negative voltage, in every horizontal period. As a result, the polarity of the charge applied to one pixel is always opposite to the polarity of the charge applied to the pixel adjacent to the pixel in the row direction.

Since the difference between the transmittance during the positive drive period and the transmittance during the negative drive period can be equalized even between the pixels vertically adjacent to each other, the flickering becomes less recognizable.

In addition, since the voltage polarity of a data electrode never fails to be inverted every time one horizontal period has passed during one vertical (display) period, the influence of the voltage polarity inversion to all the pixels in the liquid crystal display device is made uniform.

As a result, the charge variation becomes the same irrespective of the position of each pixel on the screen, so that unevenness is less likely to be caused in an image.

In view of these advantages, the row inversion drive method is currently used most widely for a liquid crystal display device performing a gray-scale tone display.

A driver is required to output to a liquid crystal display device positive and negative voltages with respect to a common electrode, regardless the driver performs the frame inversion drive or the row inversion drive. Conventionally, a driver is required to have an output dynamic range of at least about 10 V. This requirement causes various disadvantages to an LSI for driving a liquid crystal display device.

To have an output dynamic range of 10 V for a driver, the thickness of a wiring layer or a insulating layer of the LSI, and the space between the wires in the LSI are required to be set to be larger. This increases the size of the chip and the cost of a LSI.

In order to eliminate such disadvantages, a drive method which combines an AC drive for a common electrode with the row inversion drive is proposed. In this method, a desirable dynamic range for a driver even if operating at a voltage as low as +5 V or less can be obtained.

FIG. 18 shows the waveforms of the outputs from a driver performing the aforementioned method and the driving waveform for a common electrode. In FIG. 18, voltages $V_0$ and $V_7$ indicate the outputs from a 3-bit driver which successively outputs 0 and 7, respectively. The pixel voltage with respect to the common electrode is the same as those shown in FIGS. 16 and 17. As a result, the output dynamic range of the driver is substantially increased. (As to the AC drive method for a common electrode, see Hisao Okada et al., "8.4 inch color TFT liquid crystal display device and technologies for driving the same", TECHNICAL REPORT OF THE INSTITUTE OF ELECTRONICS, INFORMATION AND COMMUNICATION ENGINEERS, Vol. 92, No. 469, pp. 27 to 33.)

FIG. 19A shows a circuit in which a data line (or a data electrode) of a liquid crystal display device is regarded as a load for a driver. As shown in FIG. 19A, the data lines are represented as distributed constant circuits, each of which essentially consists of the resistance of the data line itself and a capacitance formed between each data line and the common electrode opposed to the data line. The driver has to charge and discharge the circuits shown in FIG. 19A.

As capacitance components of the data line, a capacitance formed in the portion where the data line crosses a scanning line via an insulating film also exists. However, in the following description, the capacitance between the data line and the counter electrode which is directly related to the present invention will be analyzed.

In addition, a pixel is actually connected with a data line via a switching element. However, the capacitance of the pixel itself is as small as 0.1 pF, for example, whereas the capacitance of a data line is 100 pF per line. Since the capacitance of the pixel itself is a negligible one with respect to a capacitive load of the driver, the capacitance of the pixel is omitted in FIG. 19A.

In the case of charging and discharging the distributed constant circuit shown in FIG. 19A between a positive voltage and a negative voltage, the circuit must be treated as a distributed constant circuit to strictly analyze the operation of the circuit in a transient state. However, in the case of charging and discharging such a circuit while regarding a period sufficiently longer than the transient period, the circuit may be treated as a concentrated constant circuit to analyze the amount of charge at the end of the transient state. Therefore, the circuit shown in FIG. 19A can be replaced by the circuit shown in FIG. 19B.

A resistance functions as a factor determining the time required for charging and discharging a load. However, since a total amount of charges to be charged and discharged is determined by a capacitance alone, it is only necessary to analyze an equivalent circuit consisting of capacitances alone while neglecting the resistances for analyzing the amount of the charges to be charged and discharged as shown in FIG. 19C.

Since the same number of such equivalent circuits as that of the data lines exist in a liquid crystal display device, an equivalent circuit functioning as a load for the entire display device can be regarded as a circuit shown in FIG. 19D in which the same number of circuits shown in FIG. 19C as that of the data lines are commonly connected with the common electrode.

In order to simplify the description of the concept of the present invention, it is assumed that the same gray-scale tone display is performed for all the pixels on one scanning line. Thus, the potentials of the electrodes on the data side shown in FIG. 19D become equal to each other. Accordingly,the capacitance can be represented as shown in FIG. 19E, wherein Cp refers to the capacitance.

Hereinafter, a case where a voltage $V_0$ is written into all the pixels will be described. In case of using the drive method combined the common electrode AC drive and the row inversion drive, the two states shown in FIG. 20A and 20B are alternately repeated.

More specifically, the gray-scale voltage supply circuit continues to discharge the data electrode (or charge negative charges), until the state shown in FIG. 20A where a charge +Qp is stored on the data electrode of a capacitor Cp, is turned into the state shown in FIG. 20B where a charge of −Qp is stored on the data electrode.

The total amount of charges, which is transferred from the data electrode to the gray-scale voltage supply circuit when the state shown in FIG. 20A turned to the state shown in FIG. 20B, is 2×(−Qp).

The common electrode driver continues to charge the common electrode until the state shown in FIG. 20A where a charge −Qp is stored on the common electrode of the capacitor Cp, is turned into the state shown in FIG. 20B where a charge +Qp is stored on the commone electrode.

The total amount of charges, which is transferred from the common electrode to the common electrode driver when the state shown in FIG. 20A turned to the state shown in FIG. 20B, is (2×Qp).

In the next period, the transition of states is from the state shown in FIG. 20B to the state shown in FIG. 20A. That is, the total amount of charges transferred by the gray-scale voltage supply circuit, is (2×Qp), while the total amount of the charges transferred by the common electrode driver is 2×(−Qp).

In the case where a digital driver having a configuration shown in FIG. 10 is employed, the charges necessary for charging or discharging the data line are borne by the gray-scale voltage supply circuit.

Circuits having a configuration shown in FIG. 21 are employed as the gray-scale voltage supply circuit and the common electrode driver. When the gray-scale voltage supply circuit $A_0$ outputting a gray-scale voltage VO transfers charges (2×Qp) to the data line, the transistor $Tr_1$ is turned ON and the charges are supplied from the high-level voltage supply $V_{High}$. At the same time, the transistor $Tr_4$ is turned ON and the charges 2×(−Qp) are transferred from the low-level voltage supply $V_{Low}$ to the common electrode by the common electrode driver B. In other words, the charges (2×Qp) are transferred from the common electrode through the transistor $Tr_4$ to the low-level voltage supply $V_{Low}$ by the common electrode driver B.

The above operation causes the transfer of charges (2×Qp) from the high-level voltage supply $V_{High}$ to the low-level voltage supply $V_{Low}$, i.e., the energy corresponding to the transfer of charge is consumed. When the gray-scale voltage supply circuit $A_0$ transfers the charges 2×(−Qp) to the data line, the charges are transferred between the low-level voltage supply $V_{Low}$ and the data line through a transistor $Tr_2$, while the charges (2×Qp) are transferred between the high-level voltage supply $V_{High}$ and the common electrode via a transistor $Tr_3$ on the side of the common electrode driver B. The energy corresponding to the transfer of charge is also consumed.

In addition, since the transfer of charge is repeated every time one horizontal period has passed in the row inversion drive, the power consumption necessary for the drive method, which combined the row inversion drive and the common electrode AC drive, becomes considerably increased as compared with that in the case of the frame inversion drive.

The above defect is regarded as peculiar to the drive method which combined the row inversion drive and the common electrode AC drive, and as a trade-off for obtaining a high-definition image without any flickering.

SUMMARY OF THE INVENTION

According to the present invention, a driver circuit for driving a capacitive load having a first electrode and a second electrode is provided. The driver circuit includes: first charging means, connected with the first electrode, for applying a charge to the first electrode during a first period and receiving a charge from the first electrode during a second period; second charging means, connected with the second electrode, for receiving a charge from the second electrode during the first period and applying a charge to the second electrode during the second period; first means for prohibiting a movement of a charge between the first charging means and the first electrode during a third period between the first period and the second period; second means for prohibiting a movement of a charge between the second charging means and the second electrode during the third period; and third means for allowing a movement of a charge between the first electrode and the second electrode during a fourth period included in the third period.

According to another aspect of the present invention, a driver circuit for driving a liquid crystal display device is provided. The liquid crystal display device includes a pair of substrates disposed so as to face each other with a display medium interposed therebetween. In the liquid crystal display device, one of the pair of substrates is provided with a data electrode thereon and the other substrate is provided with a common electrode thereon. The driver circuit includes: common electrode voltage supply means for supplying a common electrode voltage to the common electrode; gray-scale voltage supply means for supplying to the data electrode a gray-scale voltage having a polarity inverted into positive or negative with respect to a polarity of the common electrode voltage; first means for electrically isolating the common electrode voltage supply means and the common electrode from each other during a first period including a time at which the polarity of the gray-scale voltage supplied to the data electrode is inverted; second means for electrically isolating the gray-scale voltage supply means and the data electrode from each other during the first period; and third means for electrically connecting the common electrode and the data electrode with each other during a second period included in the first period.

In one embodiment, the first, the second and the third means include a switching circuit.

In another embodiment, the switching circuit includes a field-effect transistor.

In still another embodiment, the common electrode voltage supply means includes first voltage supply means for supplying a high-level direct current voltage, and second voltage supply means for supplying a low-level direct current voltage. Respective outputs from the first voltage supply means and the second voltage supply means are controlled by the first means.

In still another embodiment, the gray-scale voltage supply means includes first voltage supply means for supplying a high-level direct current voltage, and second voltage supply means for supplying a low-level direct current voltage. Respective outputs from the first voltage supply means and the second voltage supply means are controlled by the second means.

Thus, the invention described herein makes possible the advantage of providing a driver circuit allowing for a considerable reduction in the power consumption and a display of a high-definition image without any flickering.

This and other advantages of the present invention will become apparent to those skilled in the art upon reading and understanding the following detailed description with reference to the accompanying figures.

BRIEF DESCRIPTION OF THE DRAWINGS

FIG. 5 is a diagram showing a fundamental configuration for a circuit applicable to a third example of the present invention.

FIG. 6 is a waveform chart showing a relationship between the control signal CONT and the output voltage $V_{out}$ from the circuit shown in FIG. 5.

FIG. 20A shows a positive drive period. FIG. 20B shows a negative drive period.

DESCRIPTION OF THE PREFERRED EMBODIMENTS

First, a fundamental concept of the present invention will be described. According to the present invention, the charges on a data line (or a data electrode) and on a common electrode which have conventionally been lost wastefully are transferred between the data electrode and the common electrode via a bypass circuit. Only the charges, which are further needed to induce a given voltage level across the data electrode and the common electrode, are supplied by a common electrode driver and a gray-scale voltage supply circuit. As a result, the amount of charge necessarily supplied by the common electrode driver and the gray-scale voltage supply circuit is considerably reduced. The power consumption of the common electrode driver and the gray-scale voltage supply circuit can be considerably reduced as compared with the case of using a conventional drive method, even if a row inversion drive in which the common electrode is AC driven is employed.

In order to realize the above-described concept, each of the gray-scale voltage supply circuit and the common electrode driver becomes a high impedance state, during a certain period from a time before the polarity of the gray-scale voltage is inverted, to a time after the polarity of the gray-scale voltage is inverted. During an another period included in the certain period described above, the data electrode and the common electrode of a liquid crystal display device are electrically connected with each other via a bypass circuit.

Figure 1:
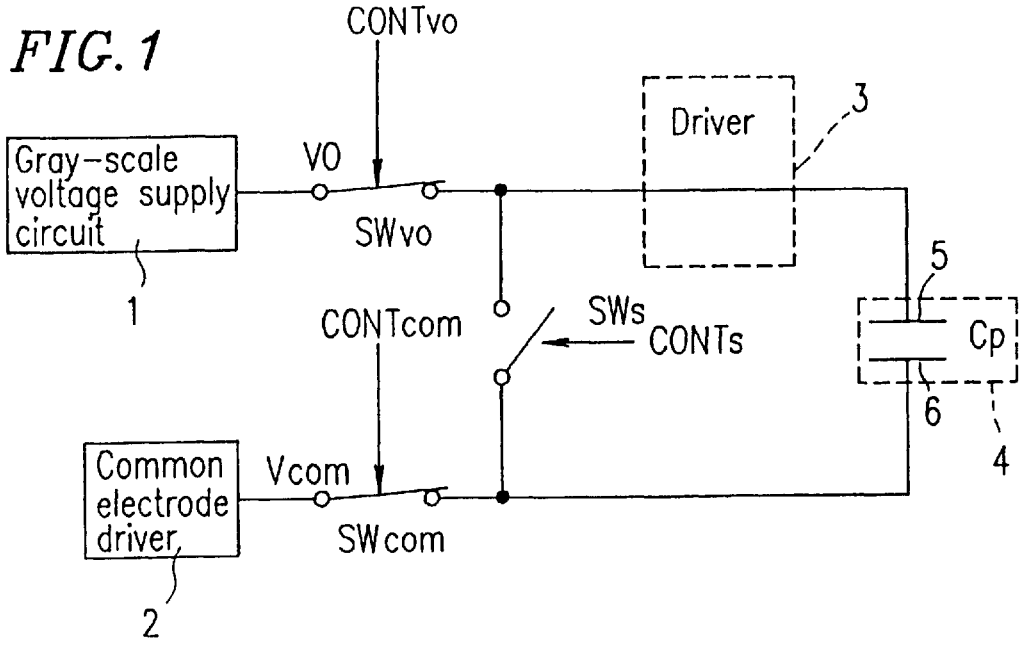
FIG. 1 is a circuit diagram illustrating a fundamental concept of the driver circuit according to the present invention.

FIG. 1 shows a fundamental concept of the driver circuit according to the present invention.: As shown in FIG. 1, the driver circuit includes a gray-scale voltage supply circuit 1 and a common electrode driver 2.

The gray-scale voltage supply circuit 1 outputs data voltages to a data electrode 5 of a liquid crystal display device 4. A voltage supply circuit outputting a rectangular wave and having a similar configuration to that of a conventional circuit can be employed as the gray-scale voltage supply circuit 1.

The common electrode driver 2 outputs common electrode voltage to a common electrode 6 of the liquid crystal display device 4.

The liquid crystal display device 4 is represented by a capacitor Cp, which will be described in detail later.

Figure 10:
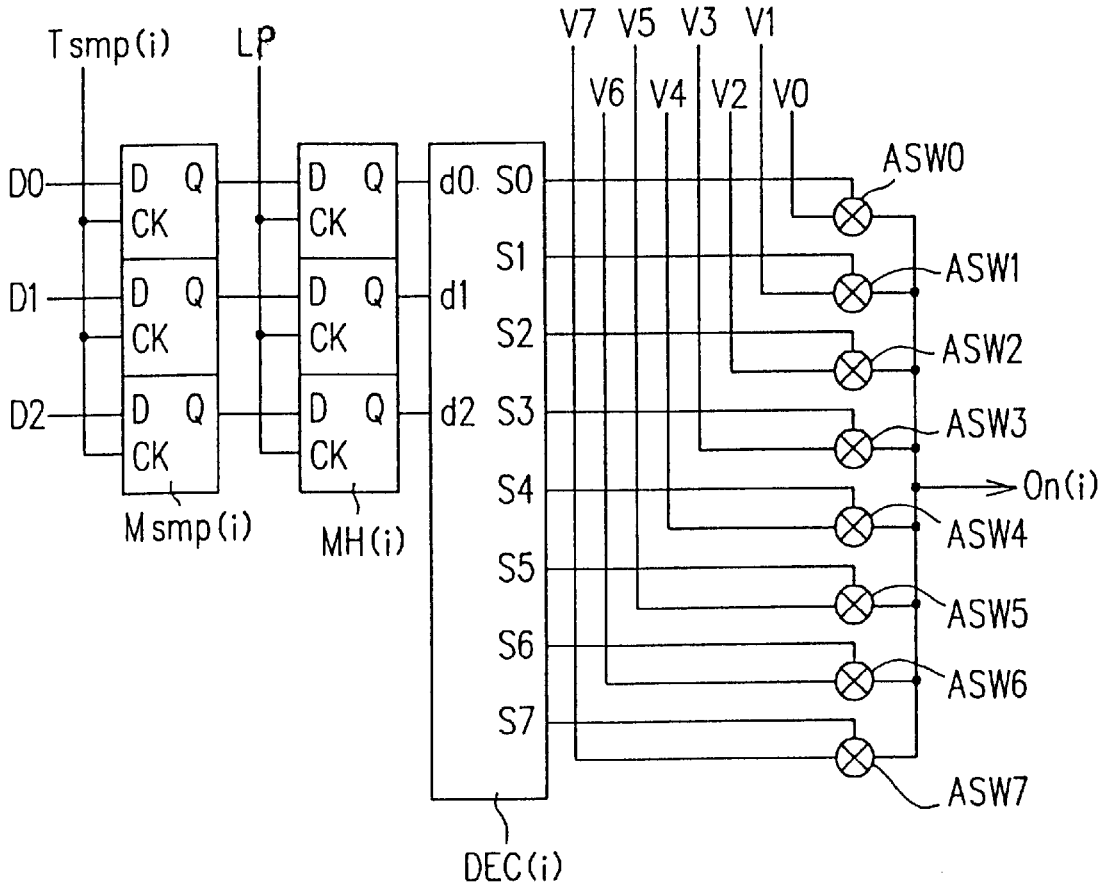
FIG. 10 is a circuit diagram showing a configuration for a data driver corresponding to one output on the i-th column shown in FIG. 9.
Figure 11:
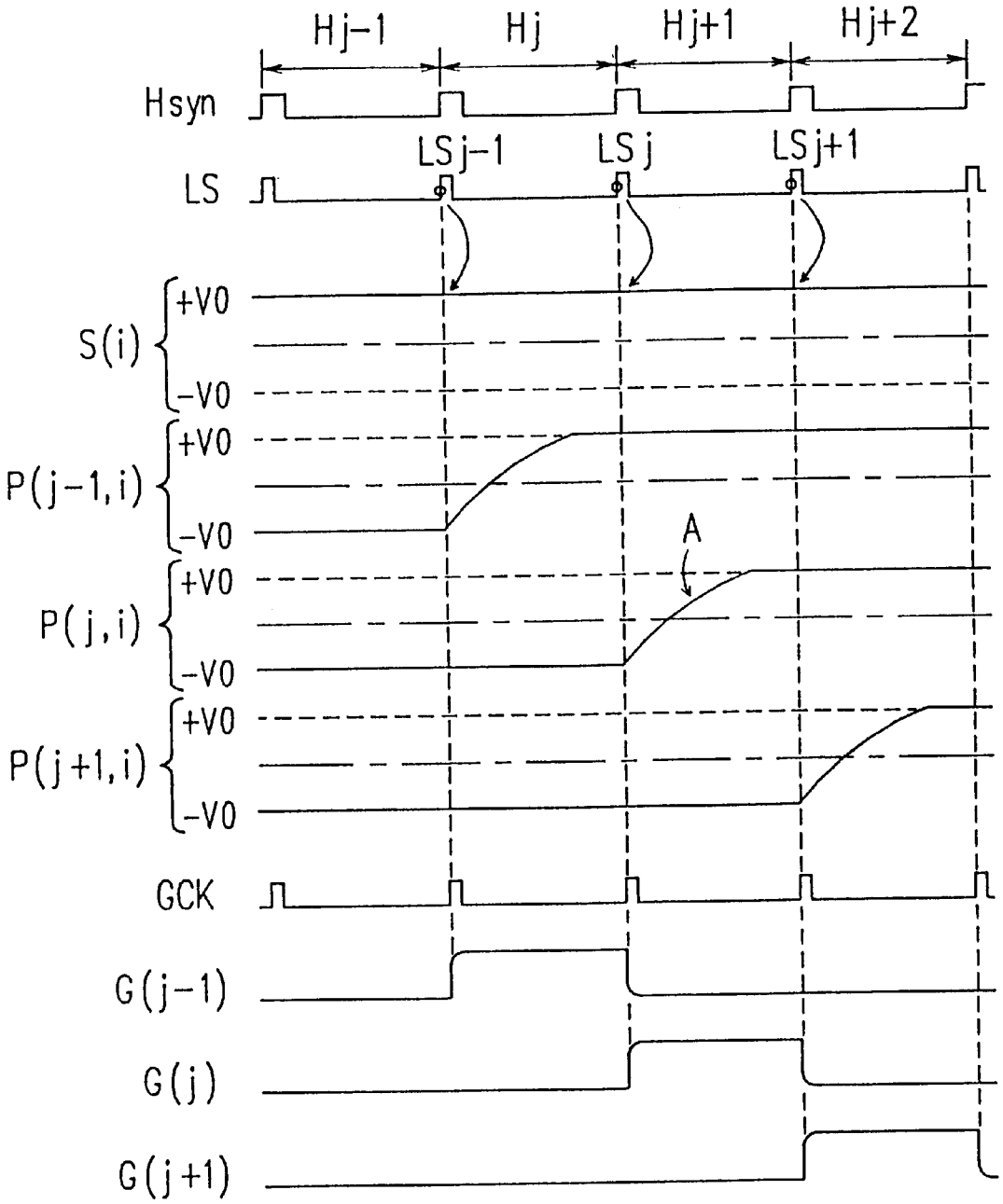
FIG. 11 is a waveform chart corresponding to one frame period during which an output voltage $V_0$ is written into all the pixels in a vertical inversion drive.
Figure 12:
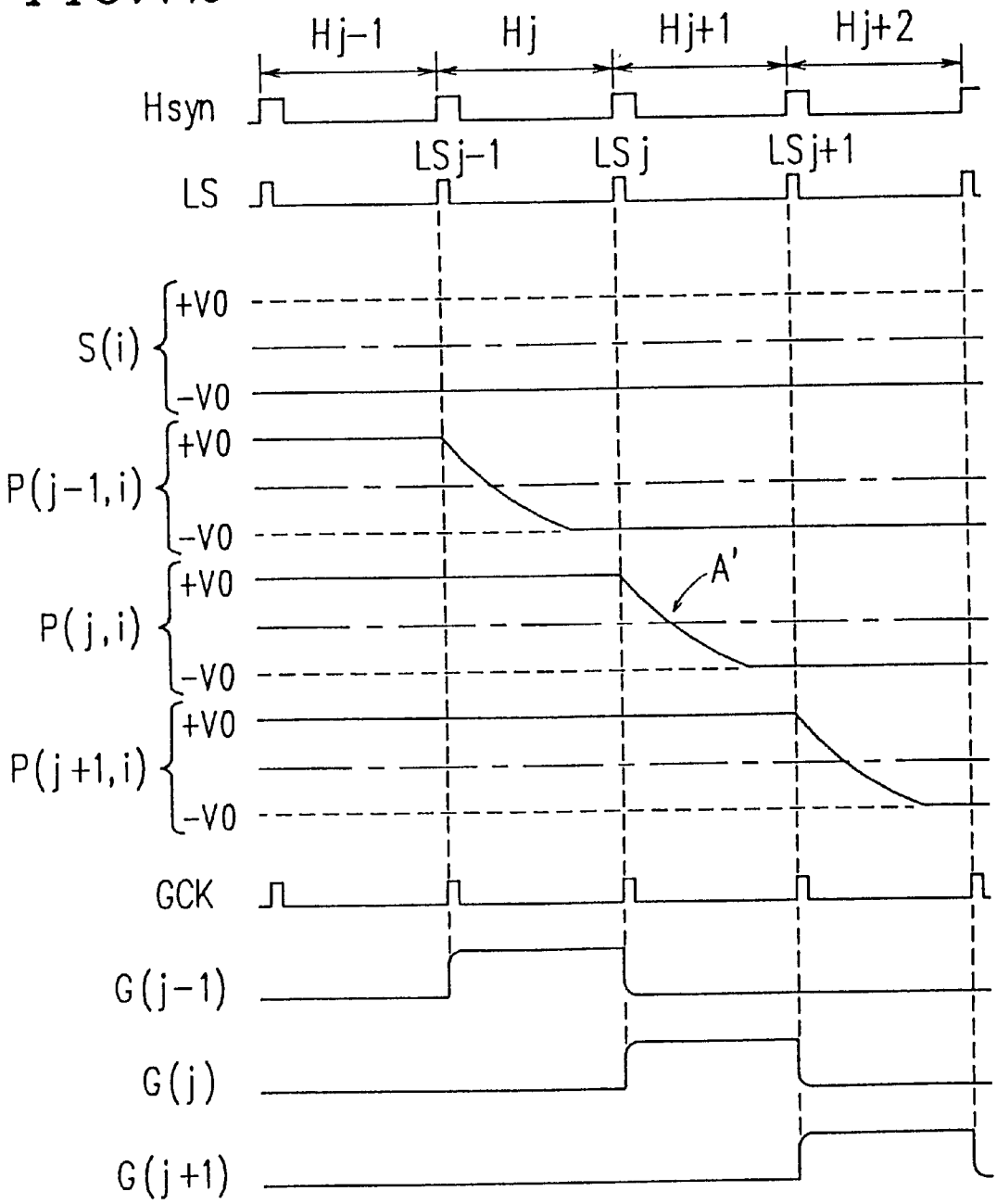
FIG. 12 is a waveform chart corresponding to the next frame period during which an output voltage $V_0$ is also written into all the pixels in the vertical inversion drive.
Figure 13A:
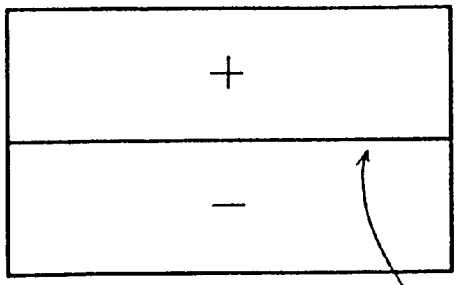
FIGS. 13A and 13B illustrate the movement of the boundary between a positive polarity region and a negative polarity region in the vertical inversion drive.
Figure 13B:
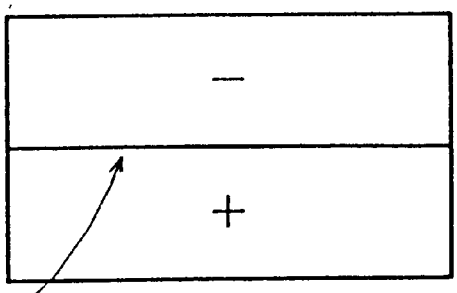
Figure 14:
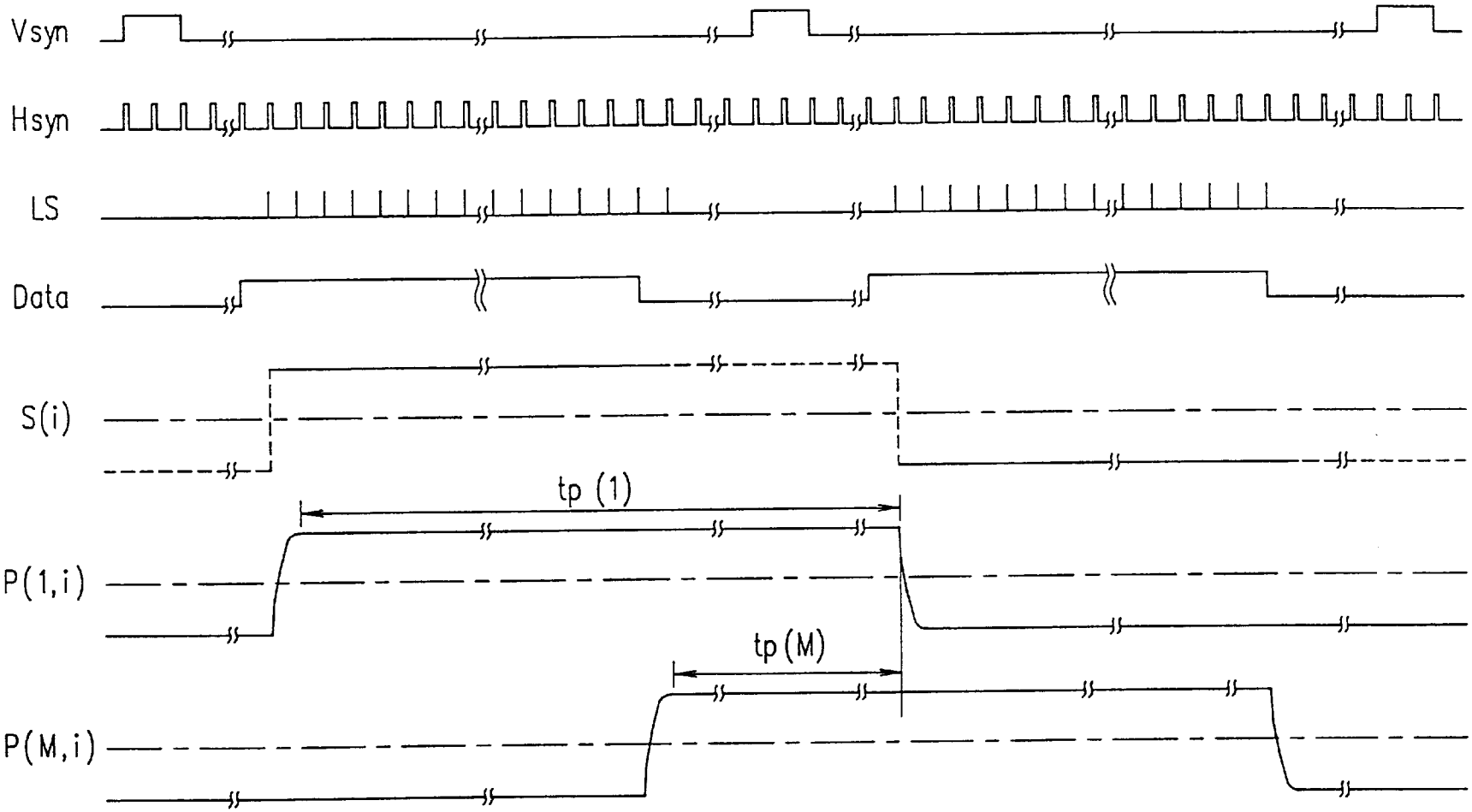
FIG. 14 is a waveform chart showing the relationship between the potential of a pixel and the potential of a data line in the vertical inversion drive.
Figure 15:
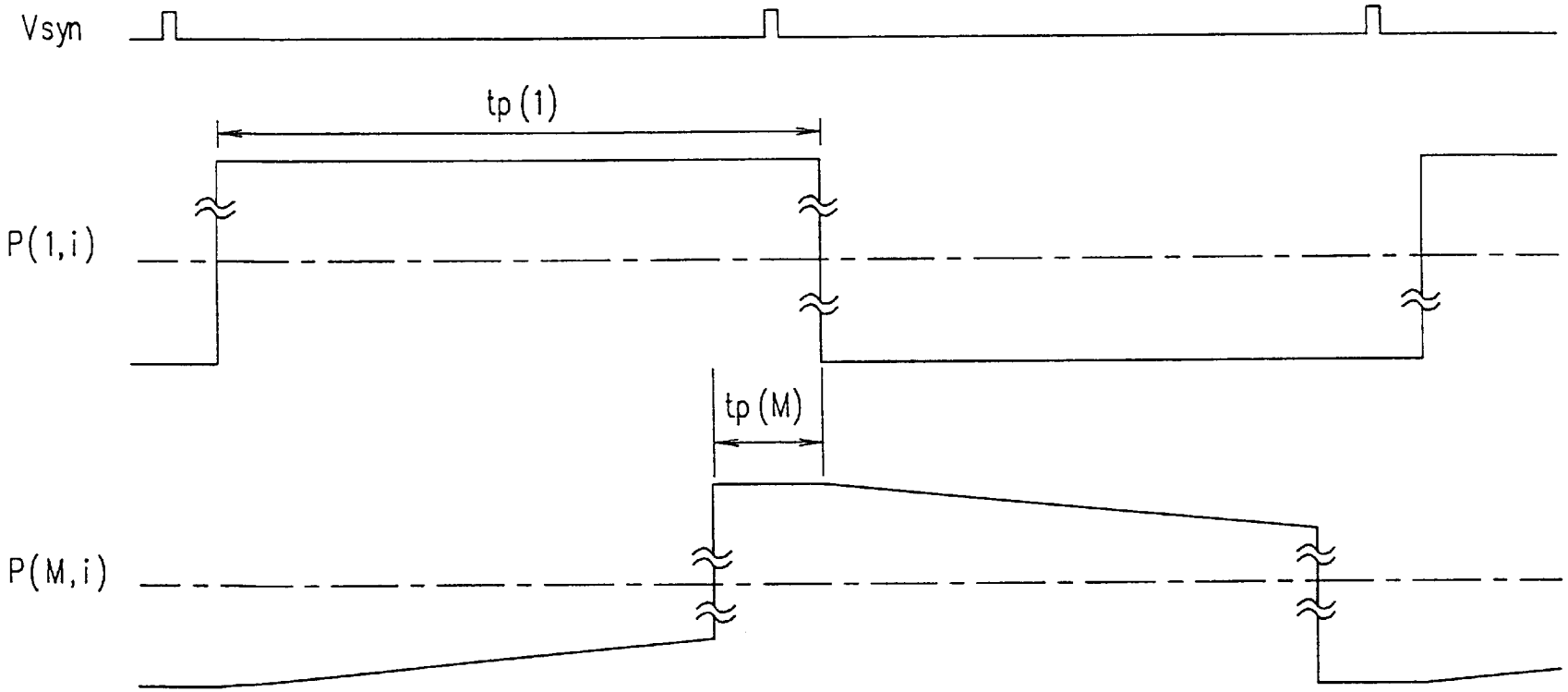
FIG. 15 is a waveform chart illustrating the potential variation of a pixel in the vertical inversion drive.
Figure 16:
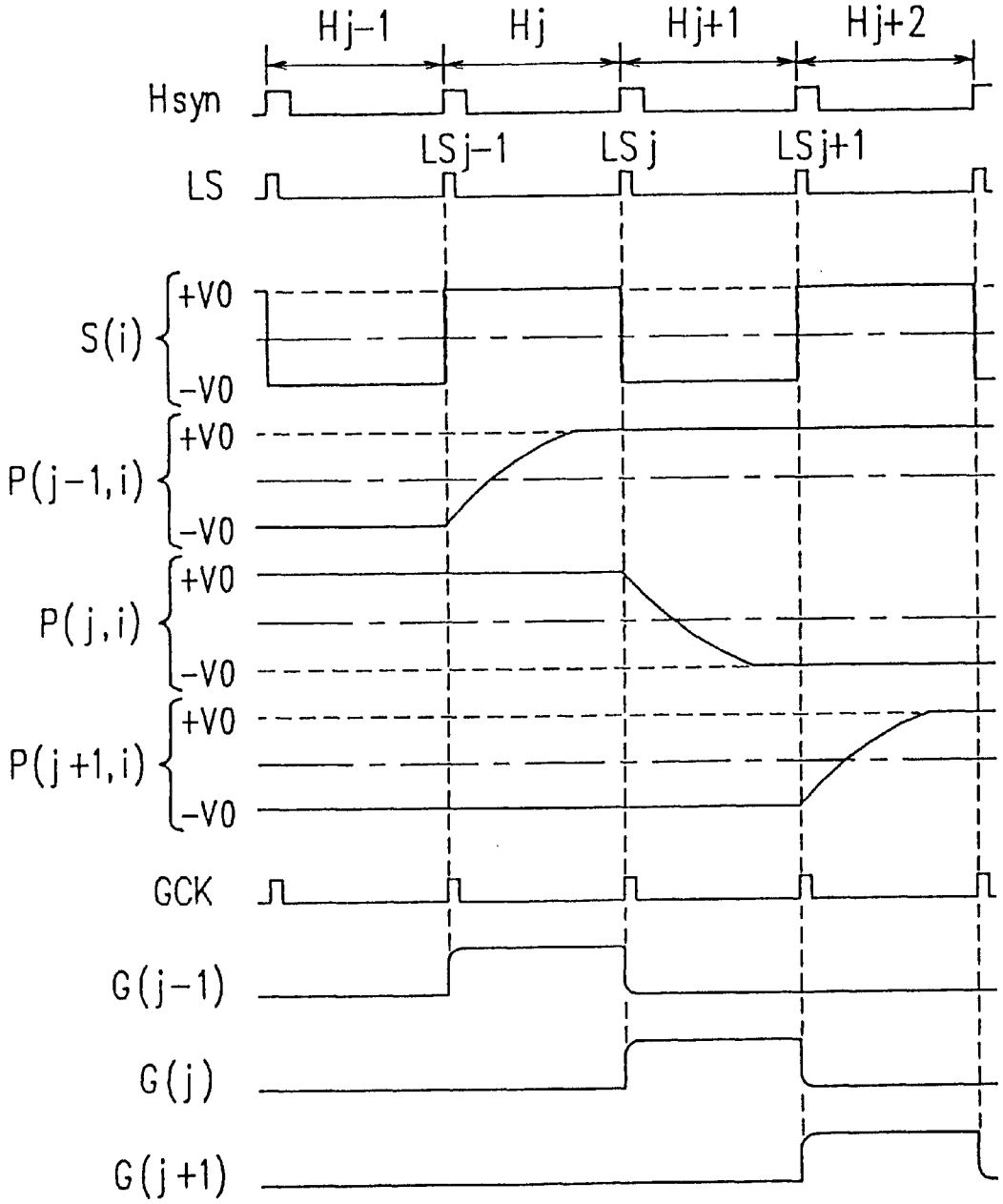
FIG. 16 is a waveform chart showing the waveforms of the respective outputs during one frame period in a row inversion drive.
Figure 17:
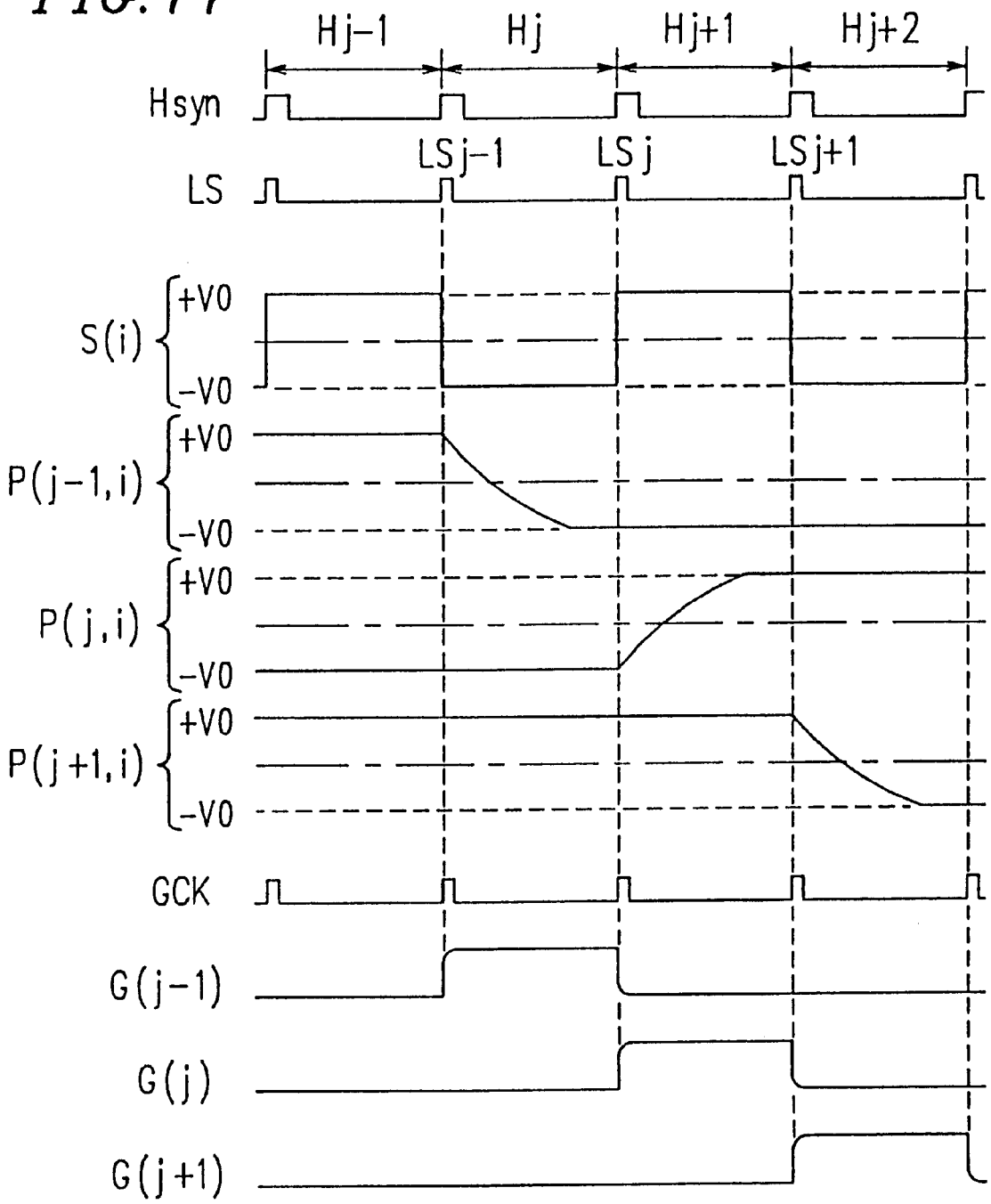
FIG. 17 is a waveform chart showing the waveforms of the respective outputs during the next frame period in the row inversion drive.
Figure 18:
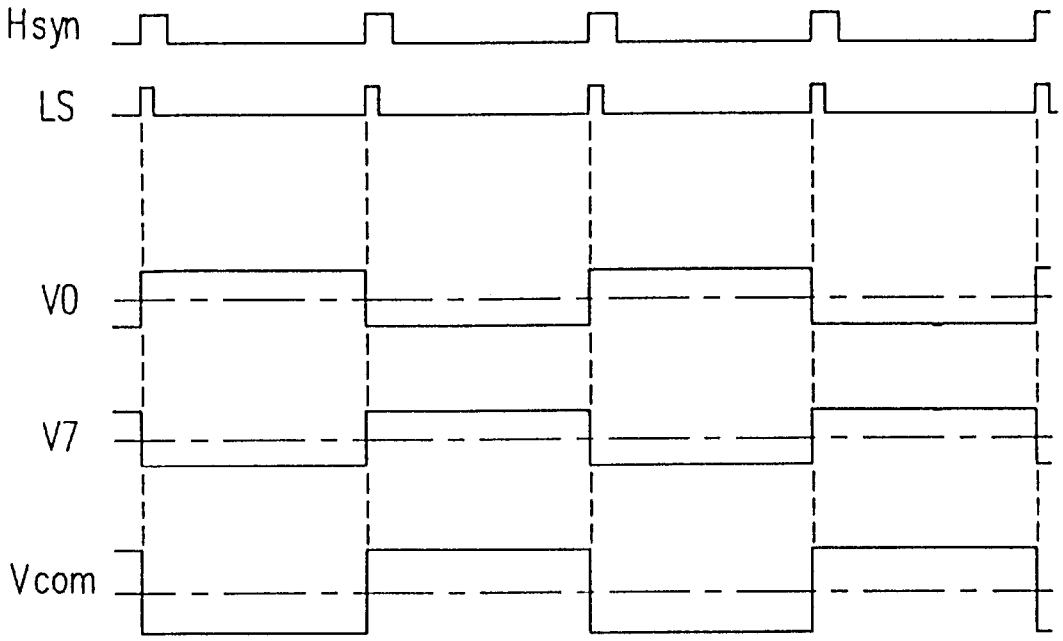
FIG. 18 is a waveform chart showing a case where the common electrode is AC driven.
Figure 19A:
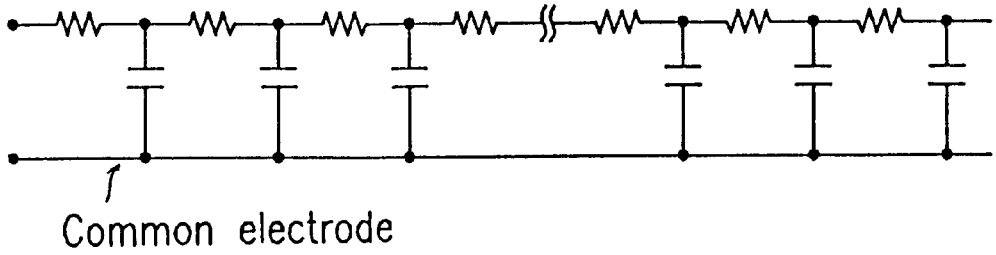
FIGS. 19A to 19E are equivalent circuit diagrams showing a case where a data line of a liquid crystal display device is regarded as a load for a driver.
Figure 19B:
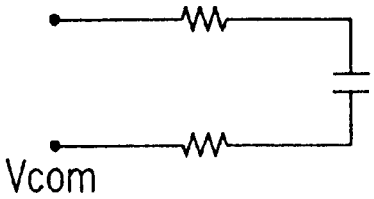
Figure 19C:
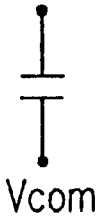
Figure 19D:
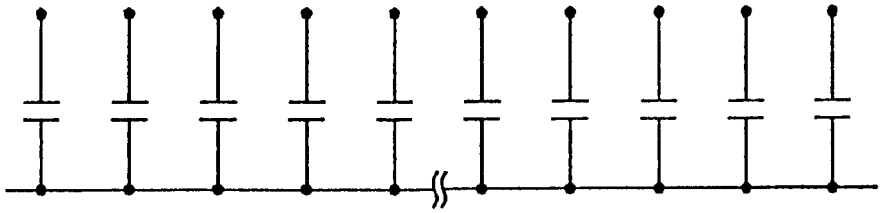
Figure 19E:
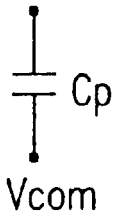
Figure 20A:
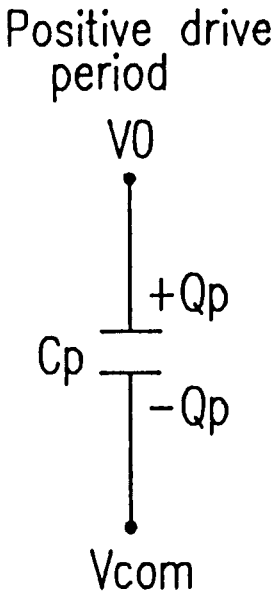
FIG. 20A and 20B are equivalent circuit diagrams illustrating charging and discharging of the charges in a common electrode AC drive method.
Figure 20B:
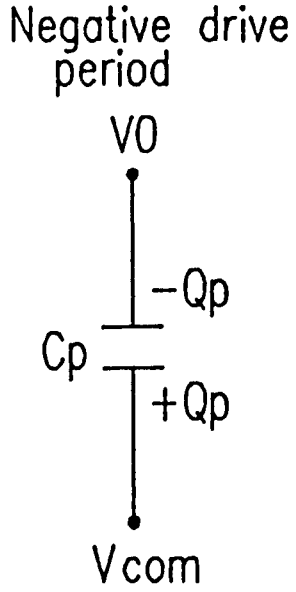
Figure 21:
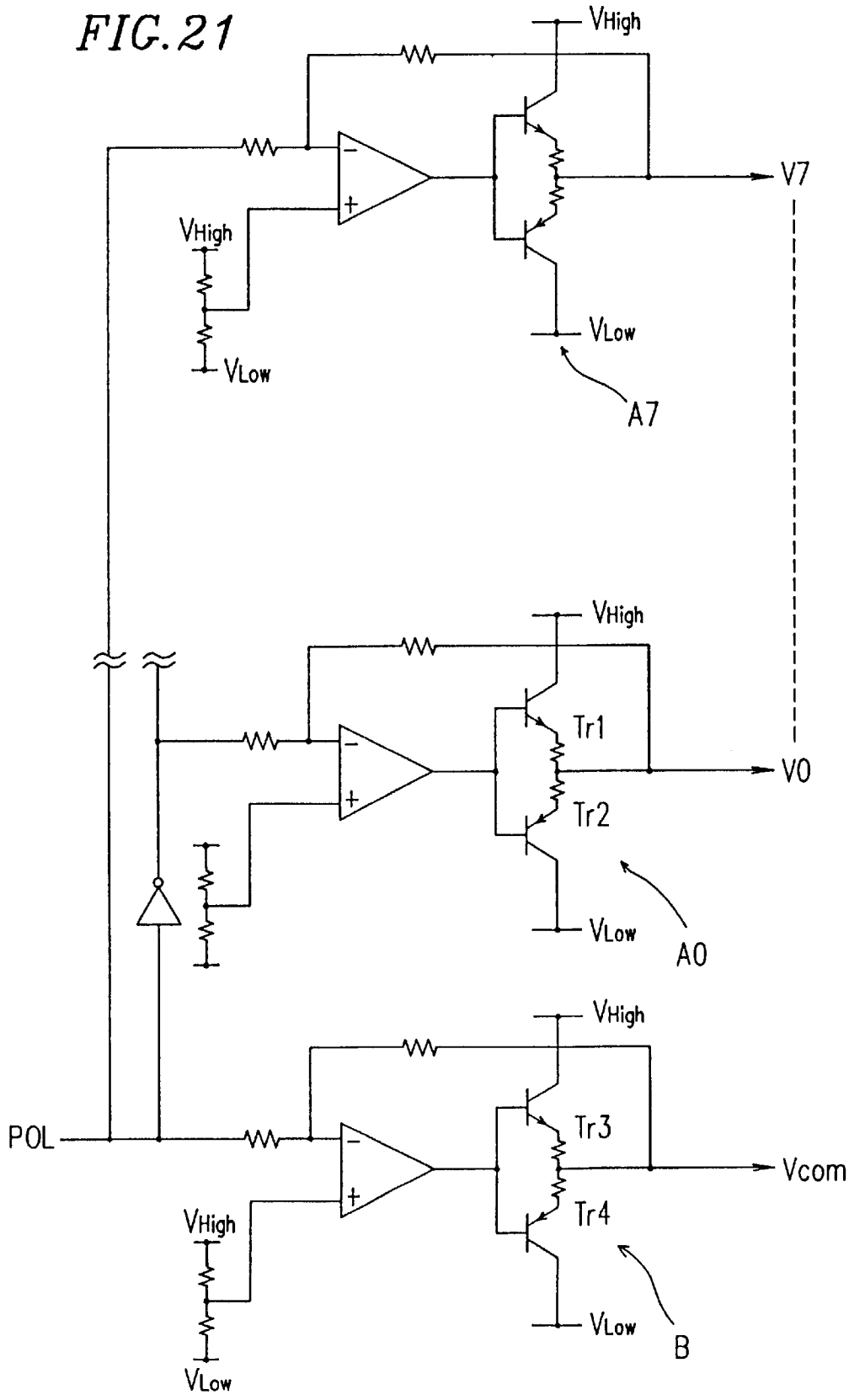
FIG. 21 is a circuit diagram showing a configuration for a conventional gray-scale voltage supply circuit and common electrode driver.

As shown in FIG. 1, the outputs from the gray-scale voltage supply circuit 1 and the common electrode driver 2 are connected with the liquid crystal display device 4 via switches $SW_{vo}$ and $SW_{com}$ respectively. The output from the gray-scale voltage supply circuit 1 is not directly input to the liquid crystal display device 4, but via a driver 3. The driver 3 has the same configuration as that of the driver shown in FIG. 10. The gray-scale voltage supply circuit 1 is connected with the liquid crystal display device 4 via an analog switch (not shown) of an output circuit (not shown) provided for the driver 3. The drive circuit shown in FIG. 1 is a simplified one showing the case of the voltage $V_0$ being selected by the driver 3.

The switches $SW_{vo}$ and $SW_{com}$ in the drive circuit shown in FIG. 1 are provided for electrically isolating the output of the gray-scale voltage supply circuit 1 and the output of the common electrode driver 2 from the liquid crystal display device 4. In other words, the switches $SW_{vo}$ and $SW_{com}$ are provided to put the gray-scale voltage supply circuit 1 and the common electrode driver 2 into a high impedance state.

In the present specification, the term "switch" is used for convenience of explanation. Any arbitrary means can be adopted as a "switch" so long as the arbitrary means allows putting the gray-scale voltage supply circuit 1 or the common electrode driver 2 into a high impedance state. In other words, any arbitrary means can be adopted as a "switch" so long as the arbitrary means can substantially prohibit the movement of charge between the liquid crystal display device 4 (i.e. a load), and the gray-scale voltage supply circuit 1, or between the liquid crystal display device 4 (i.e. a load) and the common electrode driver 2.

A switch $SW_s$ functions as a bypass circuit for electrically connecting the data electrode 5 and the common electrode 6 of the liquid crystal display device 4.

Hereinafter, the operation of the circuit shown in FIG. 1 will be described with reference to FIG. 2. It is assumed that the respective switches $SW_{vo}$ $SW_{com}$ and $SW_s$ are turned ON when the levels of the control signals $CONT_{vo}$, $CONT_{com}$ and $CONT_s$, are high. It is also assumed that these switches are turned OFF when the levels of the control signals $CONT_{vo}$, $CONT_{com}$ and $CONT_s$ are low.

Figure 2:
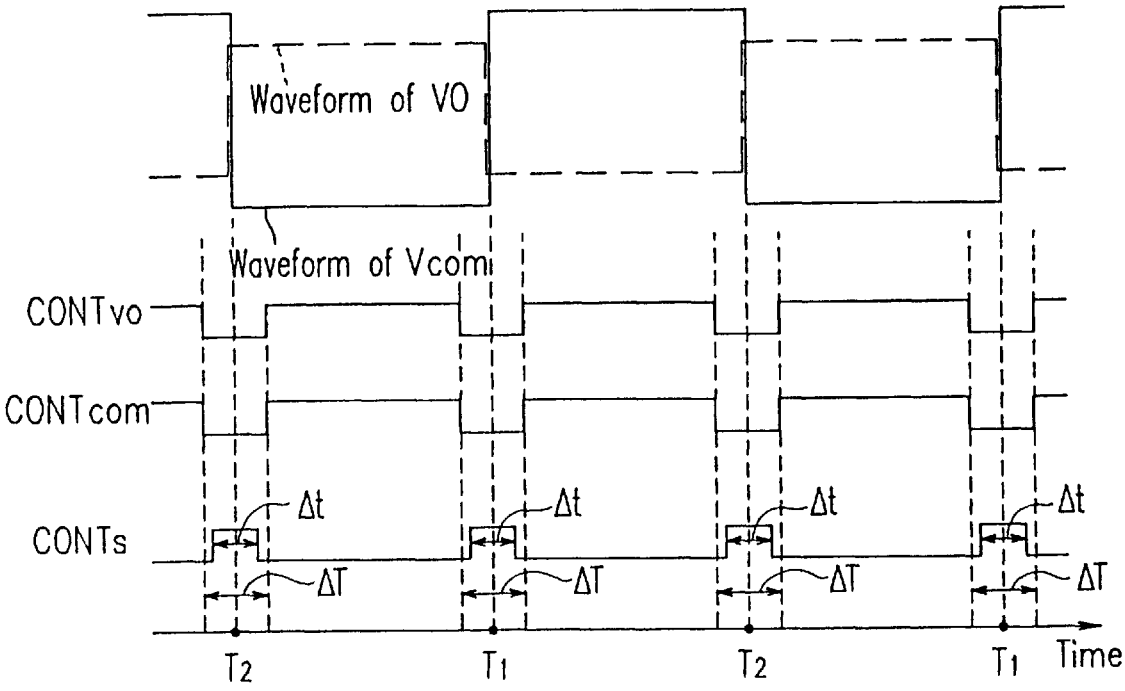
FIG. 2 is a waveform chart illustrating the operation of the driver circuit shown in FIG. 1.

FIG. 2 shows the waveform of the output voltage $V_0$ from the gray-scale voltage supply circuit 1 and the waveform of the output voltage $V_{com}$ from the common electrode driver 2. The waveform of the output voltage $V_0$ is the same as the waveform of the output voltage $V_0$ shown in FIG. 10. The voltage $V_0$ is selected and output by the gray-scale voltage supply circuit 1.

The polarity of the output voltage $V_0$ and the polarity of the output voltage $V_{com}$ are alternately inverted. In FIG. 2, T1 denotes time at which the polarity of the output voltage $V_0$ is inverted from positive to negative. T2 denotes anther time at which the polarity of the output voltage $V_0$ is inverted from negative to positive.

FIG. 2 also shows the waveforms of the control signals $CONT_{vo}$, $CONT_{com}$ and $CONT_s$, which control the ON/OFF states of the switches $SW_{vo}$, $SW_{com}$ and $SW_s$, respectively.

The control signals $CONT_{vo}$ and $CONT_{com}$ are high except for a period ΔT, as shown in FIG. 2. The period ΔT is from a time before the polarity of the gray-scale voltage is inverted, to a time after the polarity of the gray-scale voltage is inverted. As a result, the switches $SW_{vo}$ and $SW_{com}$, are ON except during the period ΔT.

The control signal $CONT_s$ is high during a period Δt included in the period ΔT. The period Δt includes time T1 or T2, as shown in FIG. 2. As a result, the switch $SW_s$ is turned ON during the period Δt.

At the beginning of the period ΔT, the levels of the control signals $CONT_{vo}$ and $CONT_{com}$ become low, so that the switches $SW_{vo}$ and $SW_{com}$ are turned OFF. The level of the control signal $CONT_s$ becomes high after the turn-off of the switches $SW_{vo}$ and $SW_{com}$ so that the switch $SW_s$ is turned ON.

Figure 22A:
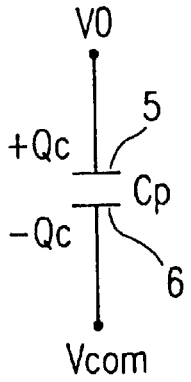
FIGS. 22A to 22C are equivalent circuit diagrams illustrating the transition of the states by charging and discharging the charges according to the present invention.
Figure 22B:
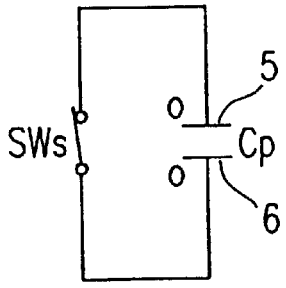
Figure 22C:
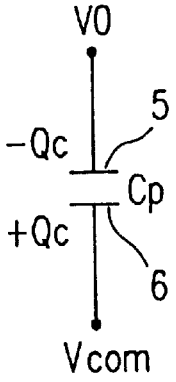

FIGS. 22A to 22C show a transition of states of the driver circuit shown in FIG. 1. Cp represents the liquid crystal display device 4 shown in FIG. 1. A data electrode 5 connected with the gray-scale voltage supply circuit 1 (FIG. 1) via the switch $SW_{vo}$ (FIG. 1). A common electrode 6 connected with the common electrode driver 2 (FIG. 1) via the switch $SW_{com}$ (FIG. 1). The data electrode 5 and the common electrode 6 can be connected with each other via the switch $SW_s$ shown in FIG. 22B.

FIG. 22A shows a state where charge +Qc appears on the data electrode 5, and charge −Qc is stored on the common electrode 6. The state shown in FIG. 22A can be obtained by charging the data electrode 5 with charge +Qc using the gray-scale voltage supply circuit 1, and by charging the common electrode 6 with charge −Qc (or discharges the electrode until −Qc, Qc>0) using the common electrode driver 2.

When the switches $SW_{vo}$ and $SW_{com}$ shown in FIG. 1 are turned OFF, and the switch $SW_s$ is turned ON, the charge on the data electrode 5 moves to the common electrode 6, or the charge on the common electrode 6 moves to the data electrode 5. As a result, both of the charges on the data electrode 5 and on the common electrode 6 substantially become zero. Thus, the state shown in FIG. 22A is transferred to the state shown in FIG. 22B.

After the above transition from the state shown in FIG. 22A to the state shown in FIG. 22B is completed, the switch $SW_s$ is turned OFF, and the switches $SW_{vo}$ and $SW_{com}$ are turned ON. The data electrode 5 is charged by the gray-scale voltage supply circuit 1 with charge −Qc (or discharged until −Qc, Qc>0), the common electrode 6 is charged by the common electrode driver 2 with charge +Qc. Thus, the state shown in FIG. 22B is transferred to the state shown in FIG. 22C. In the state shown in FIG. 22C charge −Qc is appears on the data electrode 5, and charge +Qc is appears on the common electrode 6.

The period during which the switch $SW_s$ is ON, i.e., the period Δt shown in FIG. 2, should include a period required for completing the transfer of charge between the data electrode 5 and common electrode 6 of the capacitor Cp. In other words, the period Δt should include a period required for enabling the amount of charge on the data electrode 5 to be equal to the amount of charge on the common electrode 6.

According to the present invention, the state shown in FIG. 22B exists between the state shown in FIG. 22A and the state shown in FIG. 22C along the transition of states. The transition from the state shown in FIG. 22A to the state shown in FIG. 22B is made without charging the data electrode 5 or the common electrode 6 by the voltage supply circuits with positive charge or negative charge, i.e., without consuming any energy.

The positive or negative charge supplied by the gray-scale voltage supply circuit 1 and the common electrode driver 2 is sufficient as the charge Qc for realizing the transition from the state shown in FIG. 22B to the state shown in FIG. 22C. Accordingly, the necessary amount of charge for obtaining the transition from the state shown in FIG. 22A to the state shown in FIG. 22C, is also Qc according to the present invention. However, according to a conventional method, the necessary amount of charge for obtaining the transition from the state shown in FIG. 22A to the state shown in FIG. 22C is 2Qc. According to the present invention, it is appreciated that the amount of charge for realizing the transition of states is halved, as compare with that using a conventional circuit.

When the polarity of the gray-scale voltage is inverted from negative to positive at the time T2 (FIG. 2), the state shown in FIG. 22C is transferred to the state shown in FIG. 22A via the state shown in FIG. 22B. This order of state transition is contrary to the order of state transition when the polarity of the gray-scale voltage is inverted from positive to negative mentioned above. In this case, the same effect of reducing in the amount of charge for realizing the transition of the states is also attained.

According to the present invention, it is not required that the polarity of charge on one electrode of the capacitor Cp is opposite to the polarity of charge on the other electrode of the capacitor Cp, in order to obtain the advantages of reducing the amount of charge for realizing the transition of states over a conventional method. As long as the voltage level of one electrode of a capacitor Cp is different from the voltage level of the other electrode of the capacitor Cp, the present invention is applicable. In addition, the capacitor Cp can be of any kind of a capacitive load. Further, in the present invention, the common electrode is not required to be driven in the alternating current (AC) drive method.

According to the present invention, the period Δt, during which the switch $SW_s$ shown in FIG. 1 is ON, can be shorter than the period required for enabling the amount of charge on the data electrode 5 shown in FIG. 22B to be equal to the amount of charge on the common electrode 6 shown in FIG. 22B. In such a case, the effect of reducing the amount of charge for realizing the transition of the states can be also attained to some extent.

As is apparent from the foregoing description, according to the present invention, the power required for a voltage supply circuit to drive a capacitive load can be halved, so that the power consumption can be considerably reduced.

Hereinafter, the present invention will be described by way of illustrative examples with reference to the accompanying drawings.

EXAMPLE 1

Figure 3:
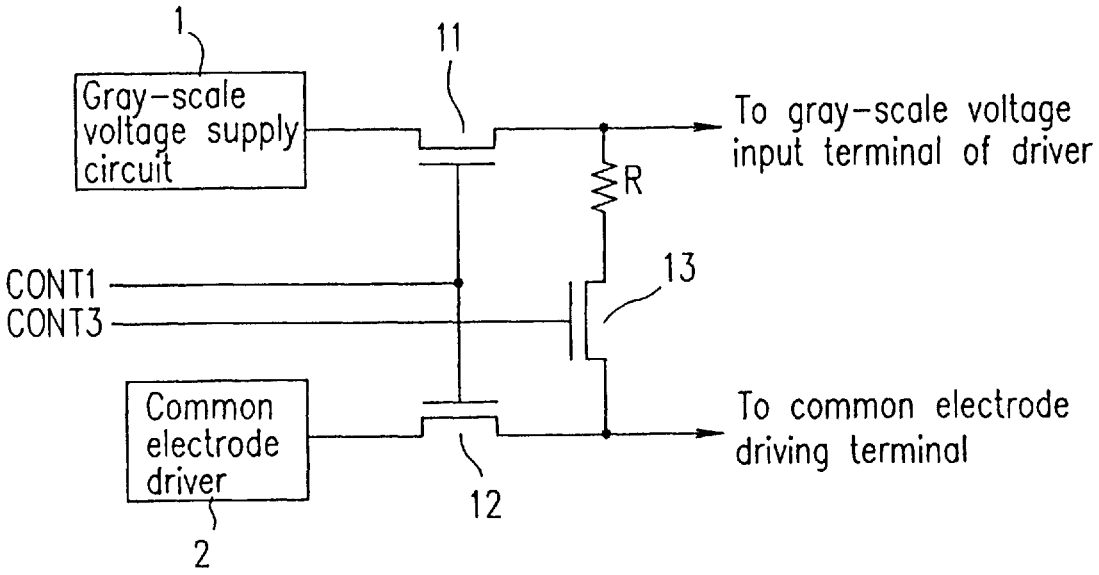
FIG. 3 is a block diagram showing a configuration for the driver circuit according to a first example of the present invention.

FIG. 3 shows an exemplary configuration for a driver circuit according to the present invention. Field-effect transistors (FETs) are used as the switches in the driver circuit.

A first FET 11 is used to electrically isolate the gray-scale voltage supply circuit 1 from the data electrode (not shown), and a second FET 12 is used to electrically isolate the common electrode driver 2 from the common electrode (not shown). The first and second FETs 11 and 12 are controlled by the same control signal CONT1.

A third FET 13 is used to electrically connect the data electrode and the common electrode. The third FET 13 is controlled by a control signal CONT3.

The resistance R connected with the third FET 13 is provided, so that a current exceeding the current-carrying capacity of the third FET 13 does not flow. The resistance R is not required to be provided depending upon the specifications of the third FET 13.

The use of the driver circuit of the Example 1 having the above-described configuration makes it possible to reduce the power of the voltage supply circuit for driving a display device to one half as compared with that of a conventional circuit, as described above relating to FIG. 1.

EXAMPLE 2

Another exemplary driver circuit according to the present invention will be described.

In general, a plurality of gray-scale voltage supply circuits are provided for a plurality of data electrodes, respectively. In such a case, a switch is required to be provided between each of the plurality of gray-scale voltage supply circuits and the corresponding data electrode of the plurality of data electrodes.

Figure 4:
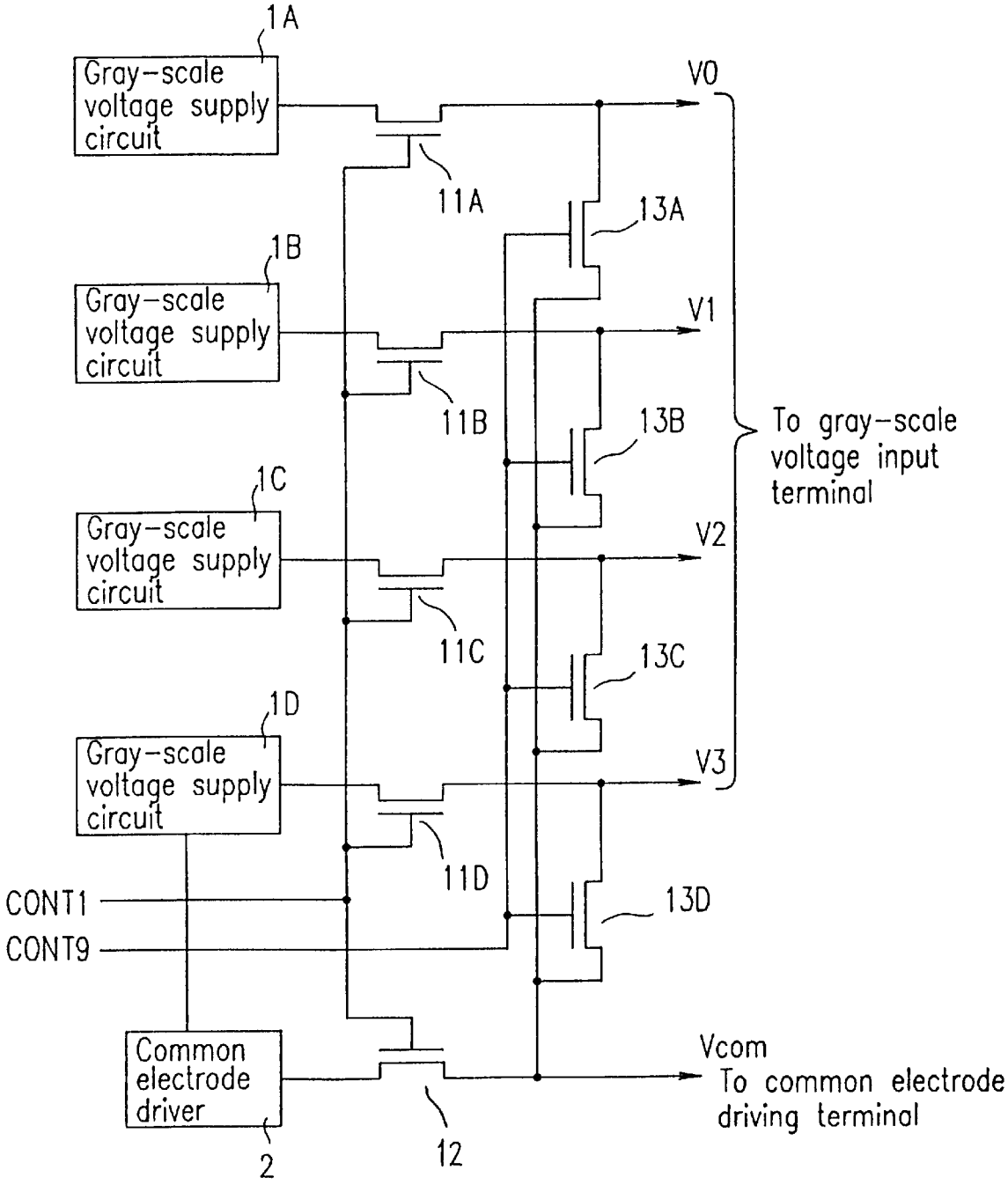
FIG. 4 is a circuit diagram illustrating the operation of a driver circuit according to a second example of the present invention.

FIG. 4 shows a case where four gray-scale voltage supply circuits 1A, 1B, 1C and 1D are provided for a liquid crystal display device (not shown).

In FIG. 4, first FETs 11A, 11B, 11C and 11D are switches used to electrically isolate the respective circuits 1A, 1B, 1C and 1D from the corresponding data electrode (not shown). A second FET 12 is a switch used to electrically isolate the common electrode driver 2 from the common electrode (not shown). The first FETs 11A, 11B, 11C and 11D and the second FET 12 are controlled by a common control signal CONT1.

Third FETs 13A, 13B, 13C and 13D are switches used to electrically connect the respective data electrodes with the common electrode. The third FETs 13A, 13B, 13C and 13D are controlled by a common control signal CONT9.

EXAMPLE 3

A still another exemplary driver circuit according to the present invention will be described.

FIG. 5 shows a exemplary configuration for a circuit of the gray-scale voltage supply circuit 1 (FIG. 1) or the common electrode driver 2 (FIG. 1). The circuit includes a high-level DC voltage supply 21 for supplying a high-level DC voltage as an output voltage Vout via a FET 23, and a low-level DC voltage supply 22 for supplying a low-level DC voltage as the output voltage Vout via a FET 24. The FETs 23 and 24 function as switches. The FETs 23 and 24 are controlled by a control signal CONT.

FIG. 6 shows waveforms of the control signal CONT and the output voltage Vout output from the circuit shown in FIG. 5. During the period in which the level of the control signal CONT is high, the FET 23 is turned ON, and the FET 24 is turned OFF. As a result, the high-level DC voltage $V_H$ output from the high-level DC voltage supply 21 is output from the circuit as the output voltage Vout.

During the period in which the level of the control signal CONT is low, the FET 24 is turned ON, and the FET 23 is turned OFF. As a result, the low-level DC voltage $V_L$ output from the high-level DC voltage supply 22 is output from the circuit as the output voltage Vout.

The period in which the level of the control signal CONT is high, and the period in which the level of the control signal CONT is low, are periodically alternated with each other. As a result, the high-level DC voltage $V_H$ and the low-level DC voltage $V_L$ are output alternately from the circuit. Thus, a rectangular wave of the output voltage Vout is obtained.

When the gray-scale voltage supply circuit 1 (FIG. 1) or the common electrode driver 2 (FIG. 1) includes the circuit shown in FIG. 5, the FETs 23 and 24 for selecting one of the high-level DC voltage and the low-level DC voltage, can also serve as switches for isolating the gray-scale voltage supply circuit 1 or the common electrode driver 2 from the liquid crystal display device 4.

Figure 7:
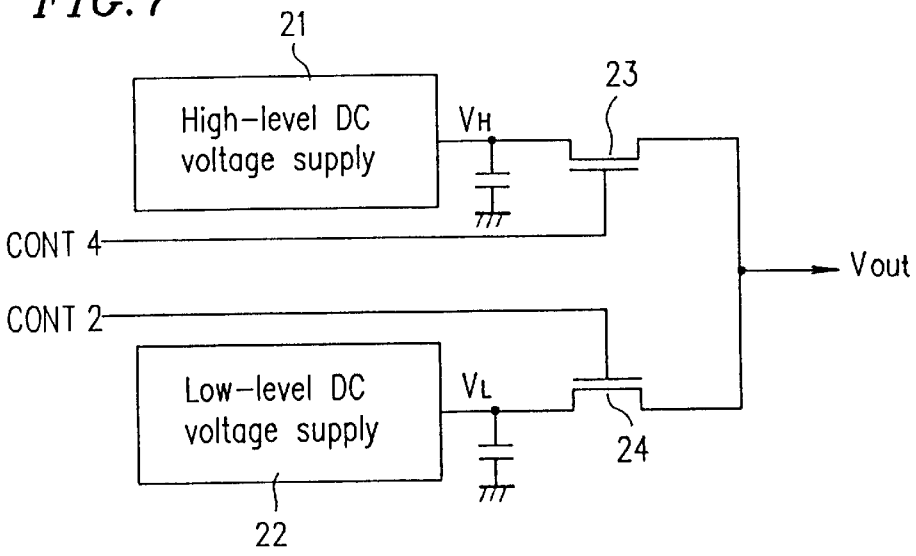
FIG. 7 is a circuit diagram showing a modified embodiment to which the circuit of the third example of the present invention is applied.
Figure 8A:
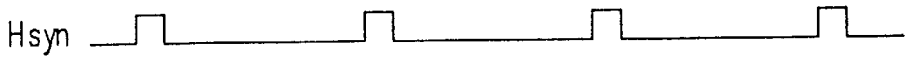
FIG. 8 is a waveform chart illustrating the control signals for controlling the FETs functioning as switches of the circuit shown in FIG. 7.
Figure 8B:
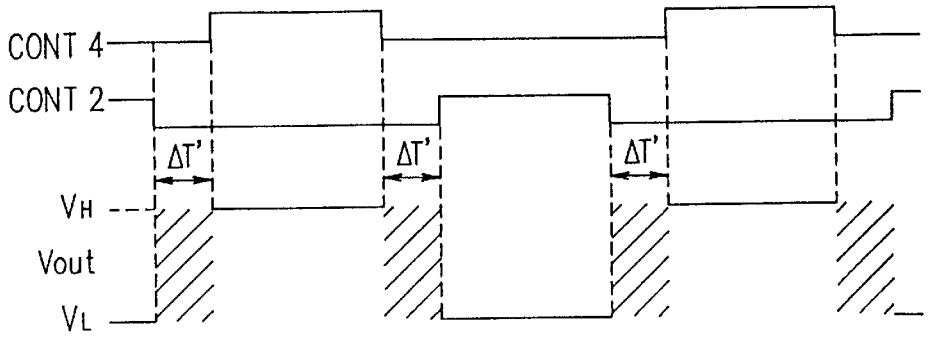
Figure 9:
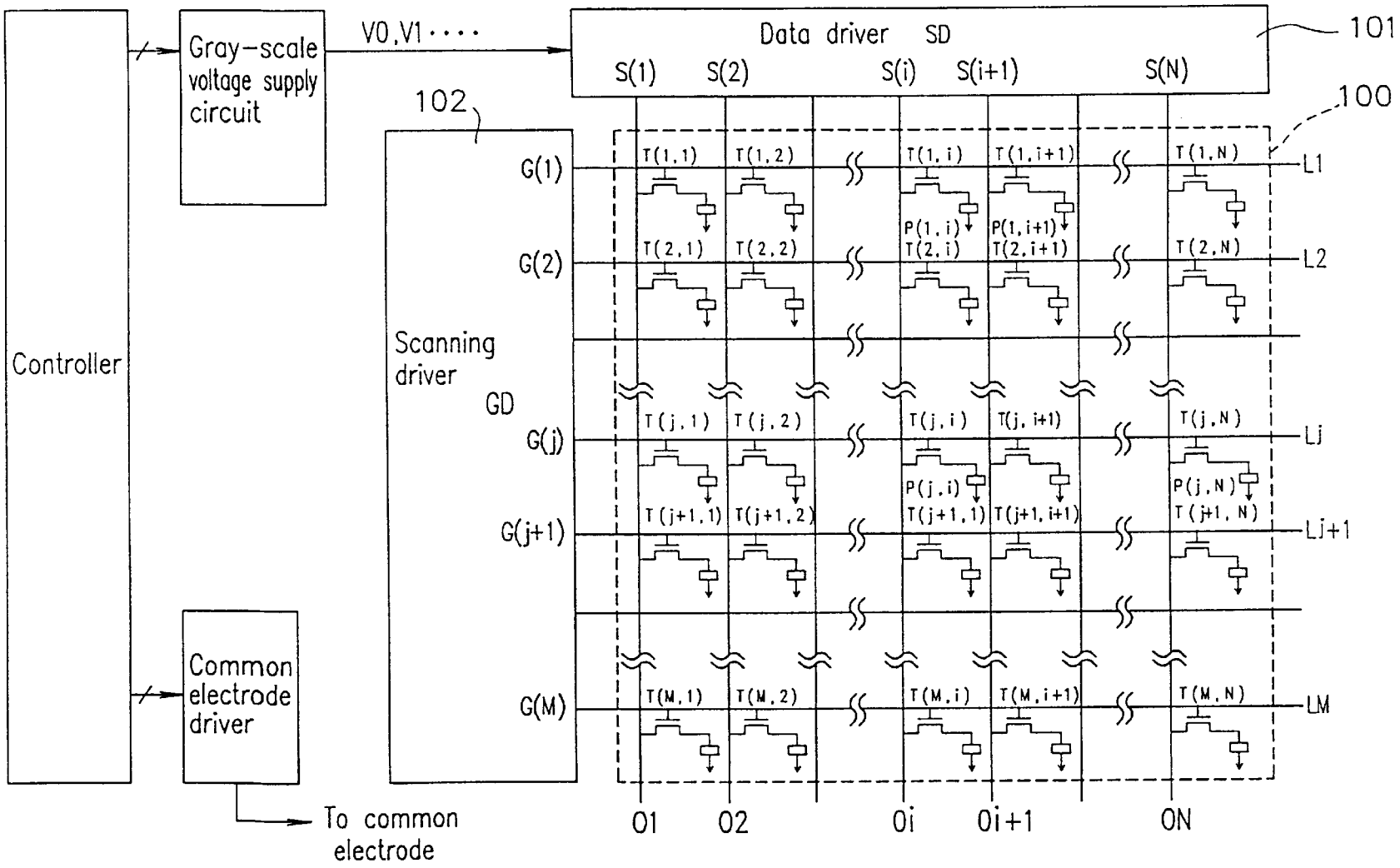
FIG. 9 is a block diagram showing a fundamental configuration for a liquid crystal display device and a driver circuit.

The FETs 23 and 24 can be controlled by different control signals CONT4 and CONT2, as shown in FIGS. 7 and 8. As shown in FIG. 8, both of the levels of the control signals CONT4 and CONT2 are low for a period ΔT'. As a result, during the period ΔT', both of the FETs 23 and 24 are turned OFF. Accordingly, the gray-scale voltage supply circuit 1 (FIG. 1) or the circuit of the common electrode driver 2 (FIG. 1) is isolated from the liquid crystal display device 4 (FIG. 1). The period ΔT' corresponds to the period ΔT shown in FIG. 2.

By using the driver circuit shown in FIG. 7, the FETs 23 and 24 for selecting one of the high-level DC voltage and the low-level DC voltage, can also serve as switches for isolating the gray-scale voltage supply circuit 1 or the common electrode driver 2 from the liquid crystal display device 4. Accordingly, it is not particularly necessary to additionally provide the switches corresponding to $SW_{vo}$ and $SW_{com}$ shown in FIG. 1.

As is apparent from the foregoing description, according to the present invention, the power consumption necessary for the drive method, in which a common electrode is AC driven and the polarity of the output voltage from a data electrode is inverted with respect to a common electrode, can be considerably reduced. According to the present invention, the row inversion drive method requiring power consumption almost as low as in the case of a vertical inversion drive method, is realized without damaging the display definition in the row inversion drive. In addition, to perform the row inversion drive, the power consumption in the case of using the circuit of the present invention can be reduced to one half as compared with that in the case of using a conventional circuit.

In the foregoing description, the capacitance of the common electrode or the data electrode is assumed to be generated between the data electrode and the common electrode, for simplified explanation. However, in fact, the capacitance of a common electrode is also formed between the common electrode and a gate electrode. The fact that a common electrode has two dimensions, in other words, has an area, also results in a capacitance of the common electrode. In addition, a capacitance is formed between a data electrode and a gate electrode, particularly at a crossing between these electrodes.

The present invention has nothing to do with how the capacitance of the data electrode or the common electrode is formed. The feature of the present invention lies in that the charge, which has conventionally been charged on the data and common electrodes, and then is wastefully lost via the gray-scale voltage supply circuit and the common electrode driver, can be used to offset the charge on the data electrode with the charge on the common electrode. The present invention essentially has nothing to do with where the capacitance of the data line or the capacitance of the common electrode comes from.

If the load of a driver (e.g., a gate electrode driver) increases due to the present invention, the loss of the advantage according to the present invention, caused by the increase of the load, had to be compensated for. The load of the driver means the amount of charge required for driving the electrode which forms a capacitance with the data electrode or the common electrode.

However, according to the present invention, the above problem never occurs. This is because the amount of charge required for driving the electrode (e.g., a gate electrode) of the gate driver, is determined by a capacitance of the gate electrode, and by a potential difference between the gate electrode and a counter part electrode forming the capacitance. The capacitance of the gate electrode is formed by a capacitance peculiar to the gate electrode, a capacitance formed between the gate electrode and the common electrode, and a capacitance formed crossing the gate electrode and the data electrode. Thus, the amount of charge of the gate driver, which is required for driving the gate electrode, has nothing to do with where the charges of the electrode, which and the gate electrode form a capacitance, come from.

In the foregoing description, the present invention is applied to a digital driver including an analog switch driver which selects a gray-scale voltage among a plurality of gray-scale voltages supplied thereto, and outputting the selected gray-scale voltage to a data electrode of a liquid crystal display device. However, the present invention essentially has nothing to do with the configuration of the driver. The present invention can be modified in various manners depending upon the configuration of the driver to be employed.

As has been described in detail above, the present invention makes possible to provide a driver circuit allowing for a considerable reduction in the power consumption and a display of a high-definition image without any flickering.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driver circuit for driving a capacitive load having a first electrode and a second electrode, the driver circuit comprising:

a first charging circuit, connected with the first electrode, for applying a charge to the first electrode during a first period and receiving a charge from the first electrode during a second period;

a second charging circuit, connected with the second electrode, for receiving a charge from the second electrode during the first period and applying a charge to the second electrode during the second period;

a first circuit for prohibiting a movement of a charge between the first charging circuit and the first electrode during a third period between the first period and the second period by electrically disconnecting the first charging circuit from the first electrode;

a second circuit for prohibiting a movement of a charge between the second charging circuit and the second electrode during the third period by electrically disconnecting the second charging circuit from the second electrode, so that both sides of a power source in communication with said first and second electrodes are cut off for isolation purposes;

a third circuit for allowing a movement of a charge between the first electrode and the second electrode during a fourth period included in the third period, wherein during the fourth period, a closed loop is formed which comprises the capacitive load and the third circuit, wherein the closed loop is electrically isolated from the first charging circuit and the second charging circuit, and wherein at least one of the first charging circuit and the second charging circuit provides a plurality of voltages having different levels.

2. A driver circuit according to claim 1, wherein the first, the second and the third circuits comprise a switching circuit.

3. A driver circuit according to claim 2, wherein the switching circuit comprises a field-effect transistor.

4. A drive circuit for driving an active-matrix type liquid crystal display device by combining a row inversion driver for driving a data electrode and an AC driver for driving a common electrode, the liquid crystal display device comprising a pair of substrates disposed so as to face each other with a display medium interposed therebetween, one of the pair of substrates being provided with the data electrode thereon and the other substrate being provided with the common electrode thereon, the driver circuit comprising:

the AC driver including a common electrode voltage supply circuit for supplying a common electrode voltage to the common electrode;

the row inversion driver including a gray-scale voltage supply circuit for supplying to the data electrode a gray-scale voltage having a polarity inverted into positive or negative with respect to a polarity of the common electrode voltage such that a row of pixels of the liquid crystal display and an adjacent row of pixels of the liquid crystal display have opposite polarities of both the data electrode voltage and the common electrode voltage;

a first circuit for electrically disconnecting the common electrode voltage supply circuit and the common electrode from each other during a first period including a time at which the polarity of the gray-scale voltage to be supplied to the data electrode is inverted;

a second circuit for electrically disconnecting the gray-scale voltage supply circuit and the data electrode from each other during the first period;

a third circuit for electrically connecting the common electrode and the data electrode with each other during a second period included in the first period;

wherein the AC driver for driving the common electrode reduces a dynamic range normally required to drive the common electrode;

wherein during the second period, a closed loop is formed which comprises the active-matrix type liquid crystal display device and the third circuit; and the closed loop is electrically disconnected from the common electrode voltage supply circuit and the gray-scale voltage supply circuit.

5. A driver circuit according to claim 4, wherein the first, the second and the third circuits comprise a switching circuit.

6. A driver circuit according to claim 5, wherein the switching circuit comprises a field-effect transistor.

7. A driver circuit according to claim 4, wherein the common electrode voltage supply circuit comprises a first voltage supply circuit for supplying a high-level direct current voltage, and second voltage supply circuit for supplying a low-level direct current voltage, respective outputs from the first voltage supply circuit and the second voltage supply circuit being controlled by the first circuit.

8. A driver circuit according to claim 4, wherein the gray-scale voltage supply circuit comprises first voltage supply circuit for supplying a high-level direct current voltage, and second voltage supply circuit for supplying a low-level direct current voltage, respective outputs from the first voltage supply circuit and the second voltage supply circuit being controlled by the second circuit.

9. A driver circuit according to claim 1, wherein the first changing circuit and the second changing circuit are driven by external power sources.

10. A driver circuit according to claim 1, wherein said first circuit prohibits movement of a charge between the first charging circuit and the first electrode at the same time that the second circuit prohibits movement of a charge between the second charging circuit and the second electrode during the third period.

11. A driver circuit according to claim 10, wherein said fourth period is shorter in time than said third period.

* * * * *